US007959444B2

(12) United States Patent
Corless et al.

(10) Patent No.: US 7,959,444 B2
(45) Date of Patent: Jun. 14, 2011

(54) RETRACTABLE ADAPTER

(75) Inventors: Jerry Corless, Streetsboro, OH (US); Gregory Rotenberg, Highland Heights, OH (US)

(73) Assignee: Cequent Consumer Products, Inc., Solon, OH (US)

( * ) Notice: Subject to any disclaimer, the term of this patent is extended or adjusted under 35 U.S.C. 154(b) by 0 days.

(21) Appl. No.: 12/381,287

(22) Filed: Mar. 10, 2009

(65) Prior Publication Data

US 2009/0263979 A1 Oct. 22, 2009

Related U.S. Application Data

(60) Provisional application No. 61/068,841, filed on Mar. 10, 2008.

(51) Int. Cl.
*H01R 39/00* (2006.01)

(52) U.S. Cl. ..... 439/4; 439/501; 439/35; 439/906; 439/731; 439/528

(58) Field of Classification Search ..... 439/4, 35, 439/731, 906, 501, 528
See application file for complete search history.

(56) References Cited

U.S. PATENT DOCUMENTS

| | | | | |
|---|---|---|---|---|
| 3,836,843 | A * | 9/1974 | Yonce | 324/504 |
| 5,129,828 | A | 7/1992 | Bass | |
| 5,380,209 | A | 1/1995 | Converse, Jr. et al. | |
| 5,669,471 | A | 9/1997 | Unze | |
| 5,722,854 | A | 3/1998 | Geisler | |
| 6,780,021 | B1 | 8/2004 | Owen | |
| 6,971,883 | B1 | 12/2005 | Ridge | |
| 7,172,150 | B1 | 2/2007 | Hutchison, II et al. | |
| 7,255,595 | B2 * | 8/2007 | Lo | 439/501 |
| 7,264,478 | B1 | 9/2007 | Downing | |
| 2004/0046653 | A1 * | 3/2004 | Milliken | 340/463 |
| 2005/0236243 | A1 | 10/2005 | Huang | |
| 2006/0214044 | A1 | 9/2006 | Chiang | |
| 2006/0261203 | A1 | 11/2006 | Yang | |

* cited by examiner

*Primary Examiner* — Tho D Ta
(74) *Attorney, Agent, or Firm* — McDonald Hopkins LLC

(57) ABSTRACT

The present invention provides a retractable adapter for connecting a towed vehicle to a towing vehicle. The retractable adapter may include a lower housing, an upper housing and a retractable mechanism to store the wiring harness when not in use with the towed vehicle. The lower housing may be attached to the towing vehicle. The adapter may include a rotating disc assembly, a wire guide assembly and an electrical connector or wiring harness that may be coiled around the wire guide assembly. The adapter may also include a circuit tester with light emitting diodes (LEDs) and a backup alarm. In addition, the adapter may mate a seven-way blade connector to a four-flat connecter harness.

20 Claims, 14 Drawing Sheets

RETRACTABLE ADAPTER

CROSS-REFERENCE TO RELATED APPLICATIONS

This application claims benefit from U.S. Provisional Patent Application No. 61/068,841, entitled "Retractable Adapter," filed on Mar. 10, 2008, which is hereby incorporated in its entirety by reference.

FIELD OF THE INVENTION

The present invention generally relates to an electrical connecting device and, more particularly, to a cable retracting electrical device and adapter for use with towed vehicles and the like.

BACKGROUND OF THE INVENTION

Cars, trucks and other vehicles are frequently used to pull or tow various types of vehicles or trailers for various purposes. These towed vehicles or trailers generally are provided with electrical lights that may receive power via an electrical connection with the electrical system of the towing vehicle. To that end, and for safety purposes, it is necessary to interconnect the brake lights, turn signal indicators, running lights, and the like, of the towing vehicle with the corresponding lights on the towed vehicle or trailer.

This electrical connection may include some form of connection or adapter located near where the vehicles connect together. When the towed vehicle is disconnected from the towing vehicle, the electrical connection is disengaged from the two. Since there is no place to secure or store the electrical wires, they are often allowed to dangle or drag from the towing vehicle, resulting in the wires become damaged and dirty.

As is known in the art, there are various types of wiring harness configurations and interconnecting means that may be used to achieve this purpose. Some of these configurations typically include a wiring plug attached to the trailer wiring harness and a corresponding socket or receptacle that may be secured to the vehicle wiring system.

Typically, problems often occur when the wiring harness of the towing vehicle is attached to the corresponding wiring of the towed vehicle or trailer. These problems may include finding a convenient location for storing and securing the vehicle wiring harness plug or receptacle when the trailer is disconnected from the vehicle, as well as protecting the electrical wiring that connects the trailer to the vehicle. Sometimes, animals may chew through the wiring. In addition, prolonged exposure to the elements such as snow, rain, sunlight, and the like, that may cause the electrical insulation to crack, thereby exposing the inner wiring to the weather. All of these and similar types of situations can lead to electrical circuit breaks and hazardous driving conditions.

Wiring harnesses are typically fitted with plugs or receptacles that usually dangle or trail behind the towing vehicle when the towing vehicle is not attached to a trailer or towed vehicle. Often, if not attended to frequently, the wiring will hang down and drag on the ground or roadway. Thus, the plug or receptacle is frequently damaged by contact with the ground, road surface or the frame of the towing vehicle while traveling.

There have been many attempts to minimize or eliminate the damage due to trailing plugs or receptacles that are attached to the ends of wiring harnesses in towing vehicles. Some of these attempts have included wrapping the wiring around the trailer hitch or otherwise shortening the length of the wiring harness adjacent to the plug or receptacle to prevent the plug or receptacle from being damaged by contact with the road surface or the towing vehicle frame. These attempts frequently cause the wiring to crimp, stretch or the like, sometimes making the wiring inoperative. In addition, the dangling plug or receptacle also presents an unsightly and untidy appearance.

Therefore, a need exists in the art to provide an electrical connector that is ergonomically compact, yet economical in design that conveniently allows a towing vehicle to tow a towed vehicle or trailer with a different connector, but also warns anyone around when the vehicle is going to back up, provides easy retractable storage that protects and stores the wiring harness when it is not in use, is adjustable to fit a desired length up to 42 inches, and resists dragging on the ground.

DESCRIPTION OF THE DRAWINGS

Objects and advantages together with the operation of the invention may be better understood by reference to the following detailed description taken in connection with the following illustrations, wherein.

SUMMARY OF THE INVENTION

Figure 1A:
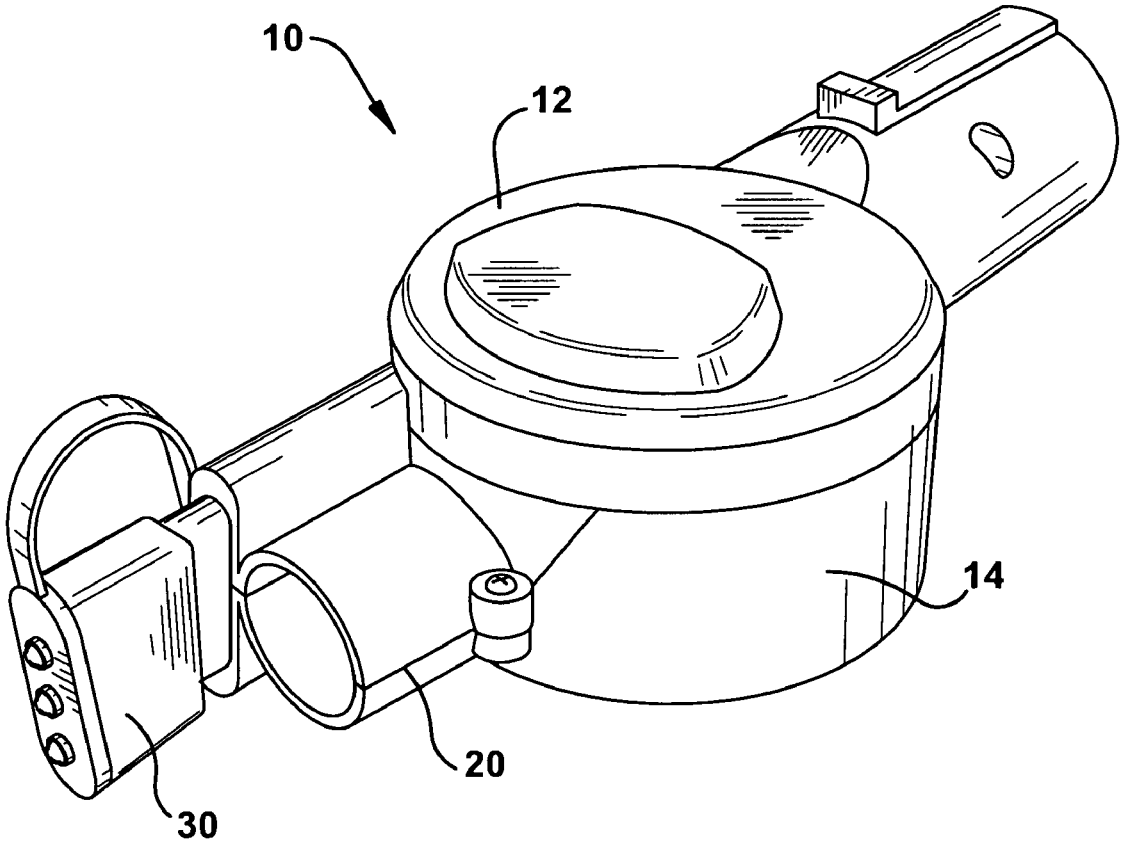
FIG. 1A illustrates a perspective view of an embodiment of an adapter.

A retractable adapter or device for connecting a towed vehicle to a towing vehicle. The retractable adapter may include a lower housing, an upper housing and a retractable mechanism to store the wiring harness when not in use with the towed vehicle. The lower housing may be attached to the towing vehicle. The adapter may include a rotating disc assembly, a wire guide assembly and an electrical connector or wiring harness that may be coiled around the wire guide assembly. The adapter may also include a circuit tester with light emitting diodes (LEDs) and a backup alarm. In addition, the adapter may mate a seven-way blade connector to a four-flat connecter harness.

DETAILED DESCRIPTION

While the invention is described herein with reference to several embodiments, it should be clear that the invention should not be limited only to the embodiments disclosed or discussed. The description of the embodiments herein is illustrative of the invention and should not limit the scope of the invention as described or claimed.

As generally described herein, the present invention provides a retractable device or adapter 10. Referring now to FIGS. 1A, 1B, 3B, 4A and 5A an embodiment of a retractable adapter 10 is shown. The adapter 10 may include an upper housing 12, a lower housing 14, a rotating disc assembly 40, a wire guide assembly 60, and a 7-way blade connector insert assembly 80. The adapter 10 may be used in conjunction with recreational vehicles, tractor-trailers, SUVs, trucks, boat trailers, cargo trailers, livestock trailers, and the like.

FIG. 1A illustrates the overall outer appearance of the adapter 10 that may include an upper housing 12, lower housing 14, an optional buzzer or alarm 20, and an optional plug-in type 4-way tester with light emitting diodes (LEDs) 30, which in addition protects the terminals when not in use. As an alternative to the plug-in type 4-way tester with LEDs 30, a built-in tester with LEDs 28 may be used, as shown in FIG. 2D. The built in tester with LEDs 28 may also continuously monitor the continuity of the circuits.

With reference to FIGS. 1A, 1B, 2A and 2B, the upper housing 12 may include a long arm 13 and a short arm 17. The arms 13, 17 may both extend outwardly from the upper housing 12 in any appropriate direction, but preferably the arms 13, 17 extend away from the upper housing 12 in an approximately opposite direction from one another. Similarly, the lower housing 14 may include a long arm 15 and a short arm 19. The arms 15, 19 may both extend outwardly from the lower housing 14 in any appropriate direction, but preferably the arms 15, 19 extend away from the lower housing 14 in an approximately opposite direction from one another.

Figure 1B:
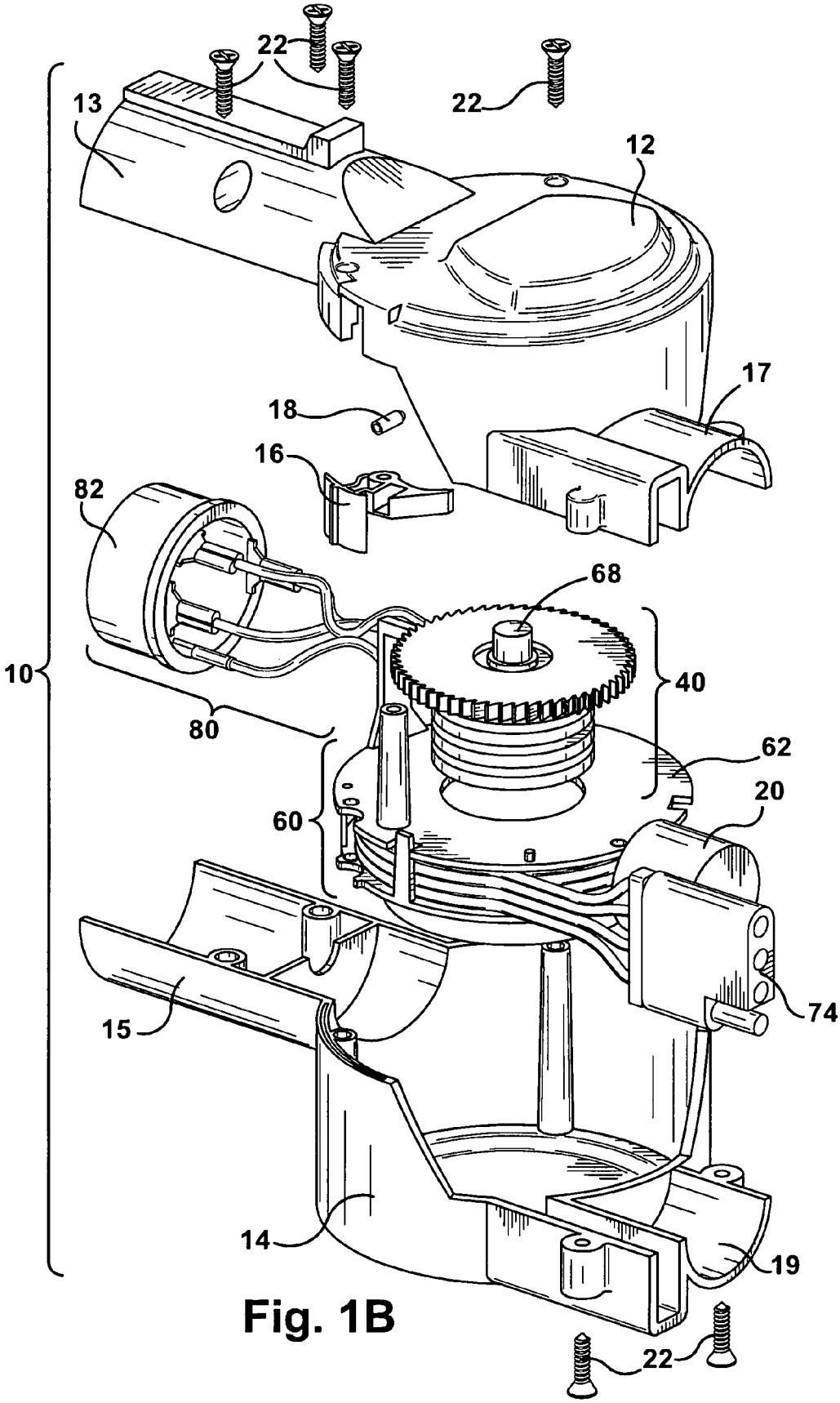
FIG. 1B illustrates an exploded view of the adapter of FIG. 1A.

FIG. 1B further illustrates the retractable adapter 10 with an exploded perspective view of an embodiment. It is to be understood that the varying components of the adapter 10 may be situated in any appropriate position or location on or within the adapter 10, however they are preferably located and positioned as described herein. The wire guide assembly 60 may be located within the lower housing 14 of the adapter 10. The rotating disc assembly 40 may also be located within the lower housing 14. The wire guide assembly 60 may be disposed between the lower housing 14 and the rotating disc assembly 40 of the adapter 10. The 7-way blade connector insert assembly 80 may be located within the arm 15 of the lower housing 14. The upper housing 12 may be slid down over the top of the various components and onto the lower housing 14 in a fitted relationship.

After the upper housing 12 is placed on top of the lower housing 14, the upper housing 12 may cover the top of the rotating disc assembly 40 and the arm 13 of the upper housing 12 may cover the other side of the 7-way blade connector insert assembly 80. Thus, when the upper housing 12 is assembled with the lower housing 14, the 7-way blade connecter insert assembly 80 may be fully encased within the arm 13 of the upper housing and the arm 15 of the lower housing.

As also shown in FIG. 1B, the adapter 10 may also include a latch 16 and a spring 18. The upper housing 12 and lower housing 14 may be attached together to contain the various components therein in a secured relationship. The upper and lower housings 12, 14 may be attached together by any appropriate means, including, but not limited to, glue, fasteners, and the like, but are preferably attached by fasteners 22. The fasteners 22 may be of any appropriate type, but are preferably mounting screws.

Figure 2A:
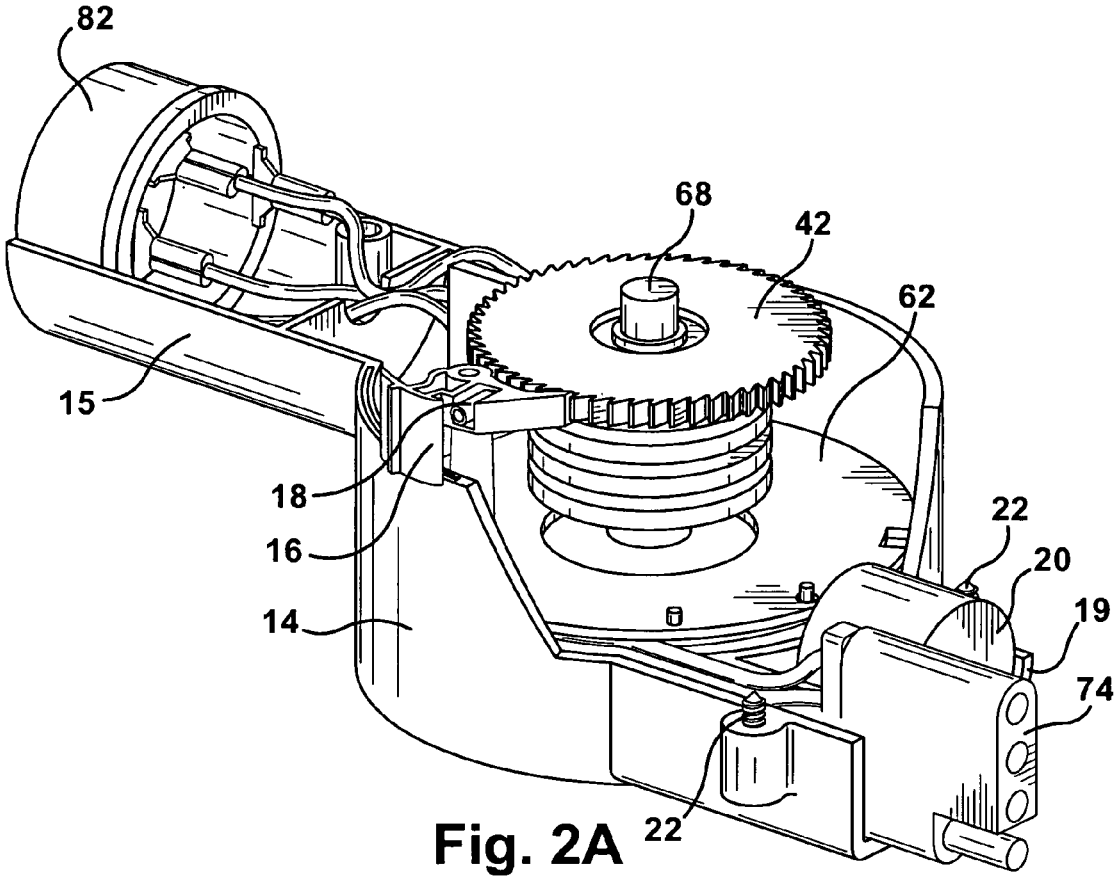
FIG. 2A illustrates a perspective view of the adapter of FIG. 1A with the upper housing removed.
Figure 2B:
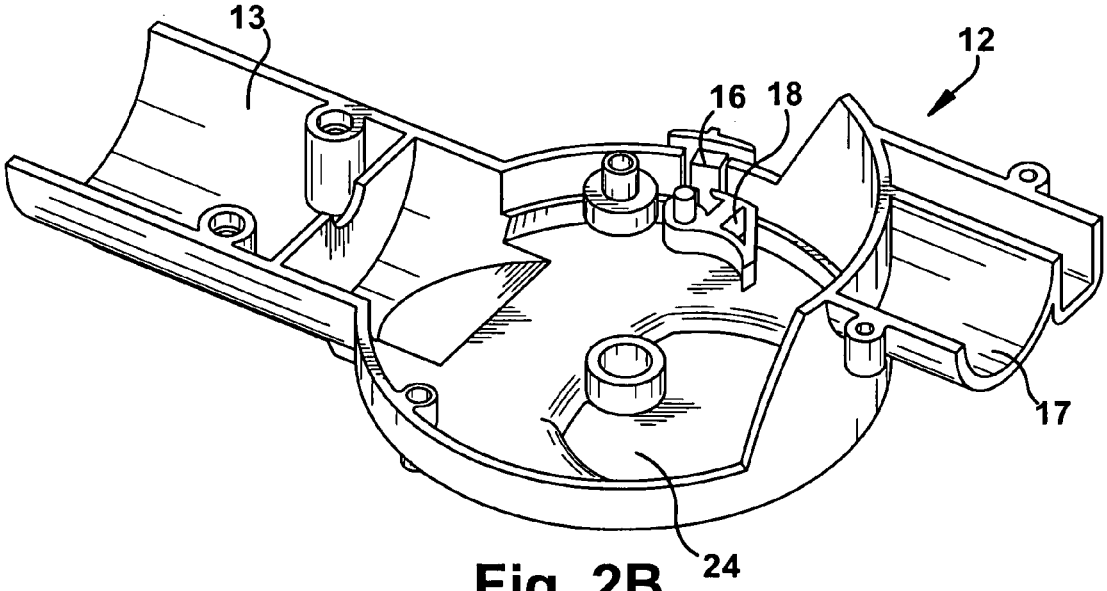
FIG. 2B illustrates a perspective view of the upper housing of the adapter of FIG. 1B.

FIG. 2A illustrates an overview of an embodiment of the adapter 10, with the upper housing 12 removed for clarity. FIG. 2A also illustrates the various components and assembly locations as they may be placed within the lower housing 14. FIG. 2B illustrates a sub-assembly of the upper housing 12. The sub-assembly of the upper housing 12 may include a bore 24, a latch 16 and a spring 18. The bore 24 may receive the end of the shaft 68 when the upper housing 12 and lower housing 14 are assembled.

Figure 6A:
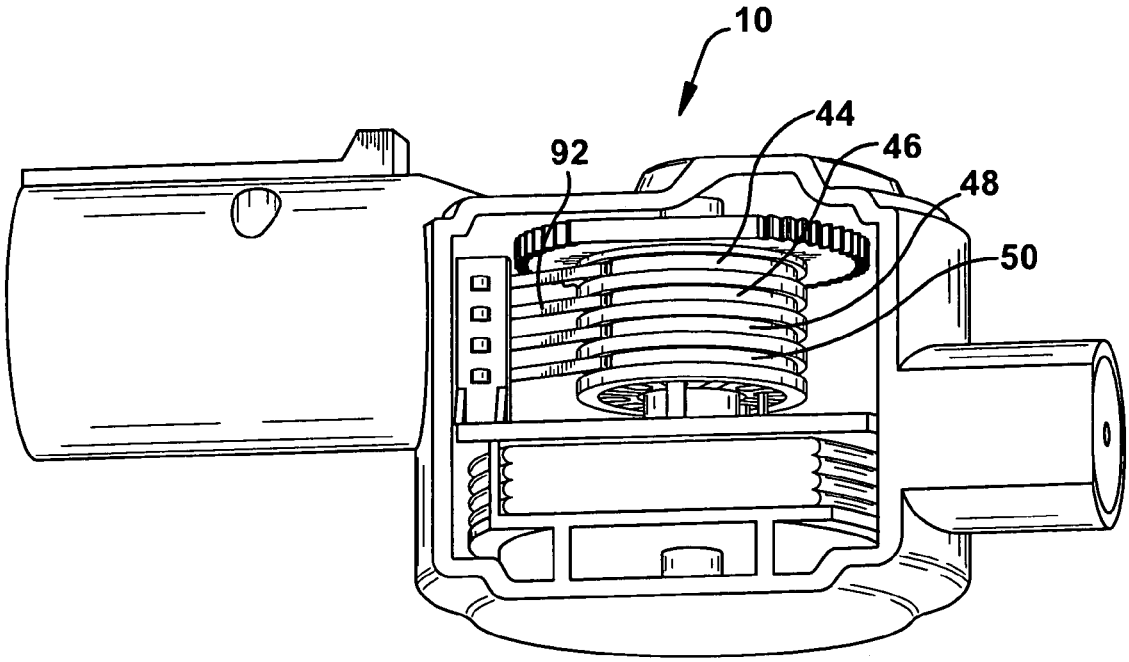
FIG. 6A illustrates a perspective cut out view of the adapter.
Figure 6B:
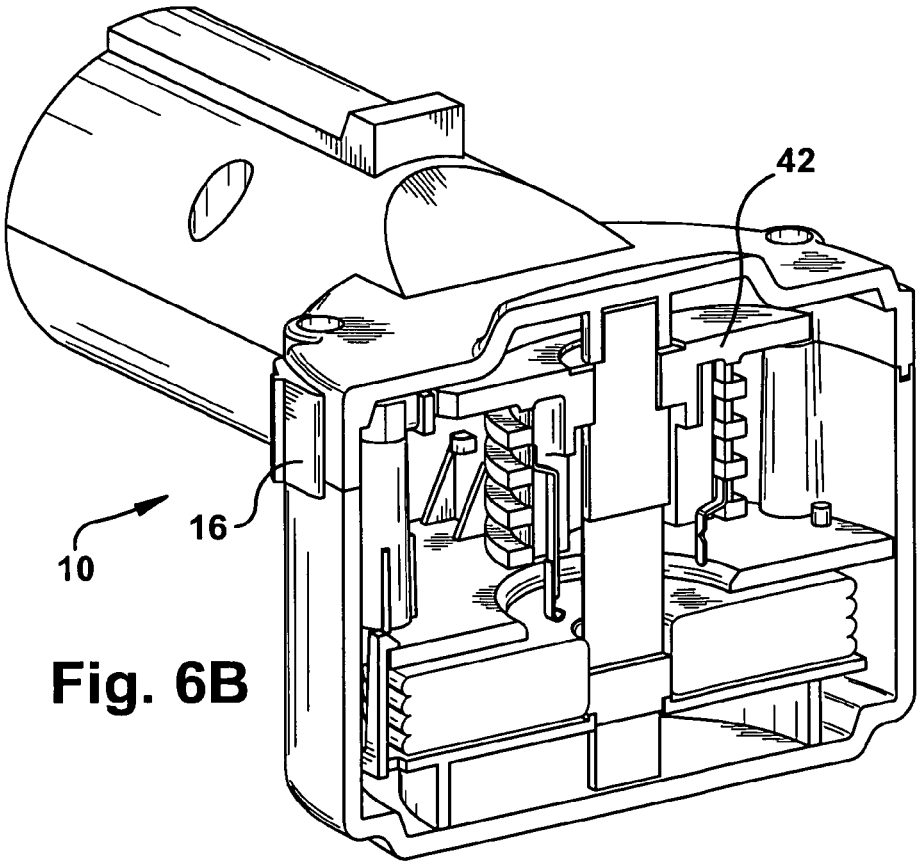
FIG. 6B illustrates another perspective cut out view of the adapter.
Figure 7A:
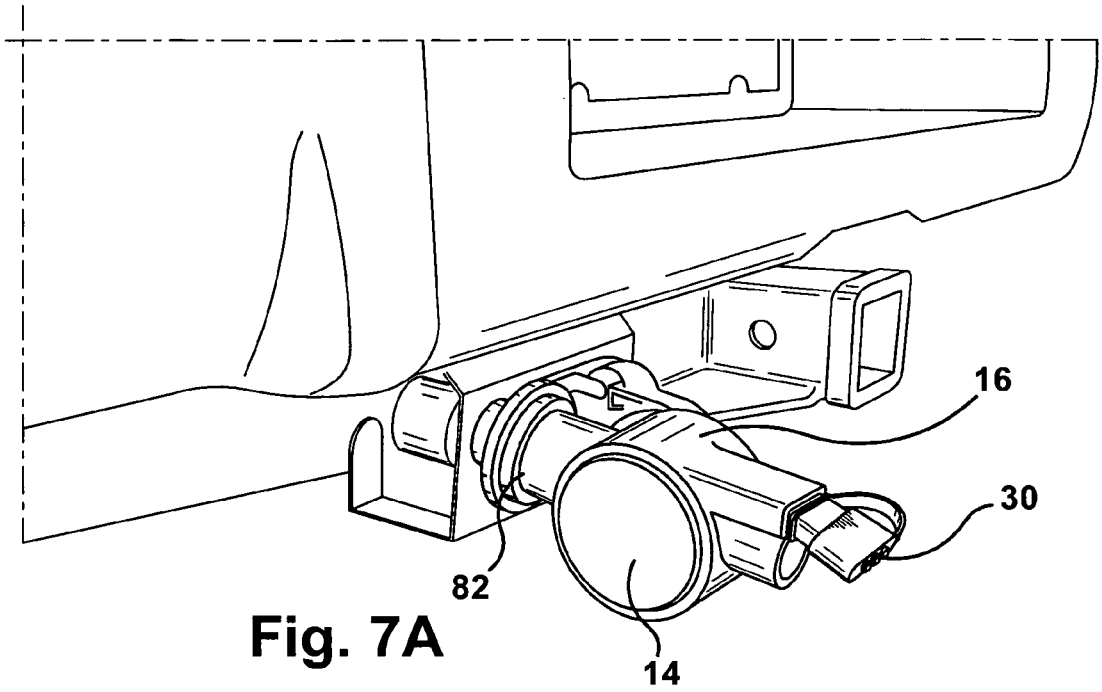
FIG. 7A illustrates a perspective view of an embodiment of the adapter in a fully retracted state.
Figure 7B:
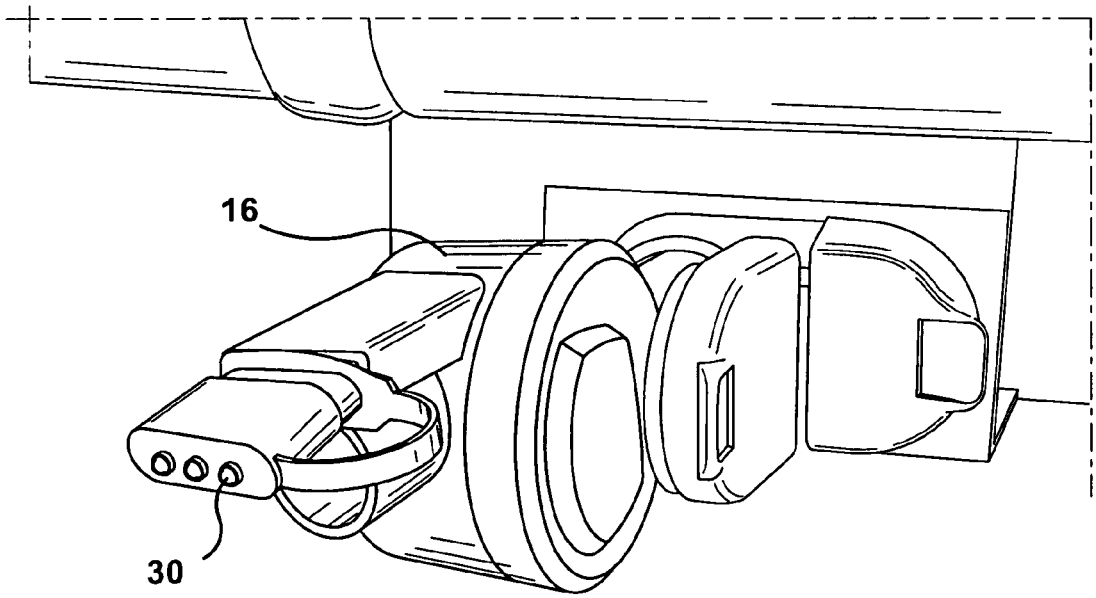
FIG. 7B shows another perspective view of the adapter of FIG. 7A having a plug-in tester with light emitting diodes.

The spring 18 may be of any appropriate size, shape and type of spring, but is preferably a compression spring. The latch 16 may be located at any appropriate location on the adapter 10, but is preferably easily reachable on the upper housing 12, as shown in FIGS. 6B, 7A and 7B. The latch 16 may preferably be spring loaded with the compression spring 18, as shown in FIGS. 2A and 2B. The latch 16 may further be engaged with the rotating disc assembly 40 so that the latch 16 may rotatably move around the ratchet body 42 of the rotating disc assembly 40 located within the upper housing 12. The connector harness 74 may freely retract to any appropriate length when the operator pushes the adjusting latch 16.

Figure 2C:
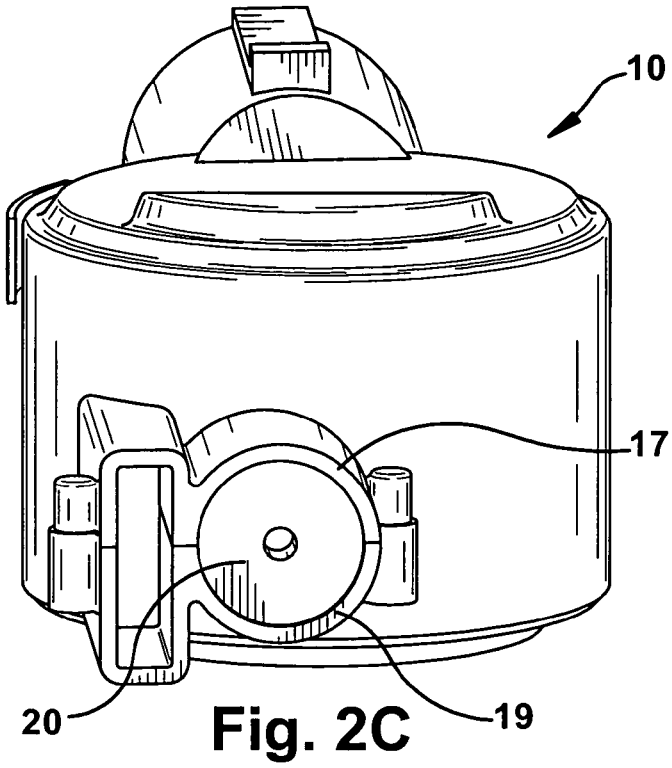
FIG. 2C illustrates a perspective view of an alternative embodiment of the adapter.
Figure 2D:
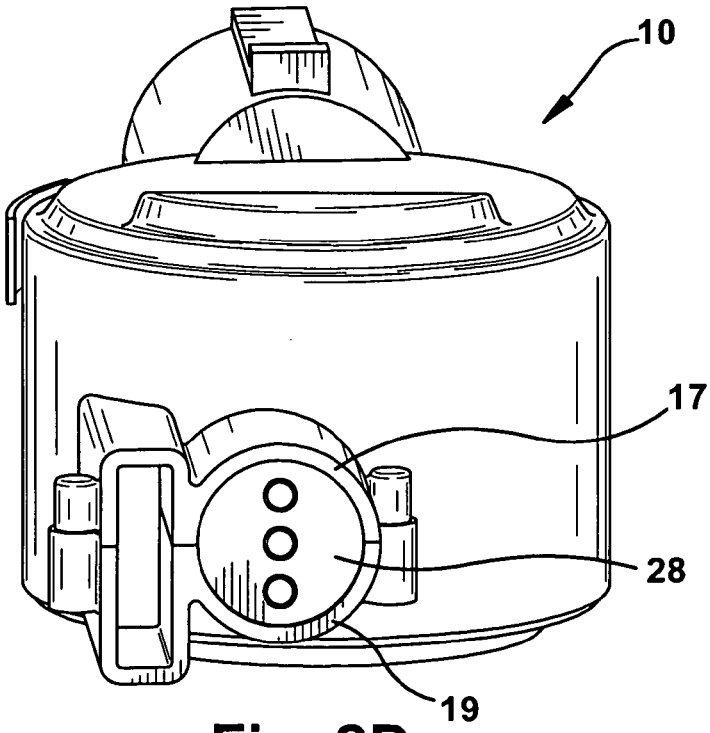
FIG. 2D illustrates a perspective view of an alternative embodiment of the adapter.

FIGS. 2C and 2D illustrate alternative embodiments of the adapter 10. FIG. 2C illustrates the retractable adapter 10 with an integrated alarm or buzzer 20. The alarm or buzzer 20 may be of any appropriate decibel level, but is preferably of at least 80 decibels. The buzzer 20 may act as any type of alarm, but preferably acts as a backup alarm that may notify the driver of the towing vehicle and any bystanders that the towing vehicle and trailer are backing up. FIG. 2D illustrates the retractable adapter 10 with an integrated tester having LEDs 28. The integrated tester with LEDs 28 may continuously monitor the continuity of the circuits as discussed above, which may also protect the terminals of the adapter 10 when not in use.

In both alternatives, as discussed above, the buzzer or alarm 20 and the integrated tester with LEDs 28 may be located within the short arm 17 of the upper housing 12 and the short arm 19 of the lower housing 14. Thus, when the upper housing 12 is assembled with the lower housing 14, the buzzer or alarm 20 may be disposed between and fully encased within the short arm 17 of the upper housing 12 and the short arm 19 of the lower housing 14.

Figure 3A:
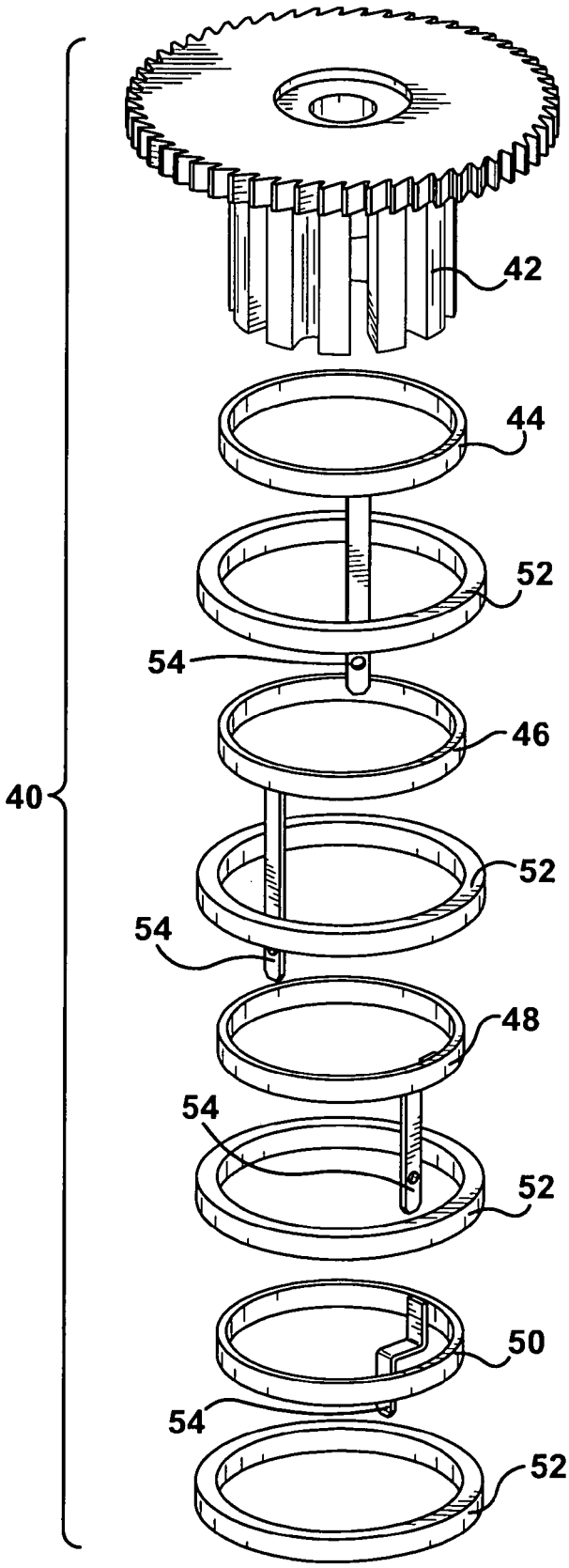
FIG. 3A illustrates an exploded view of the rotating disc of the adapter.
Figure 3B:
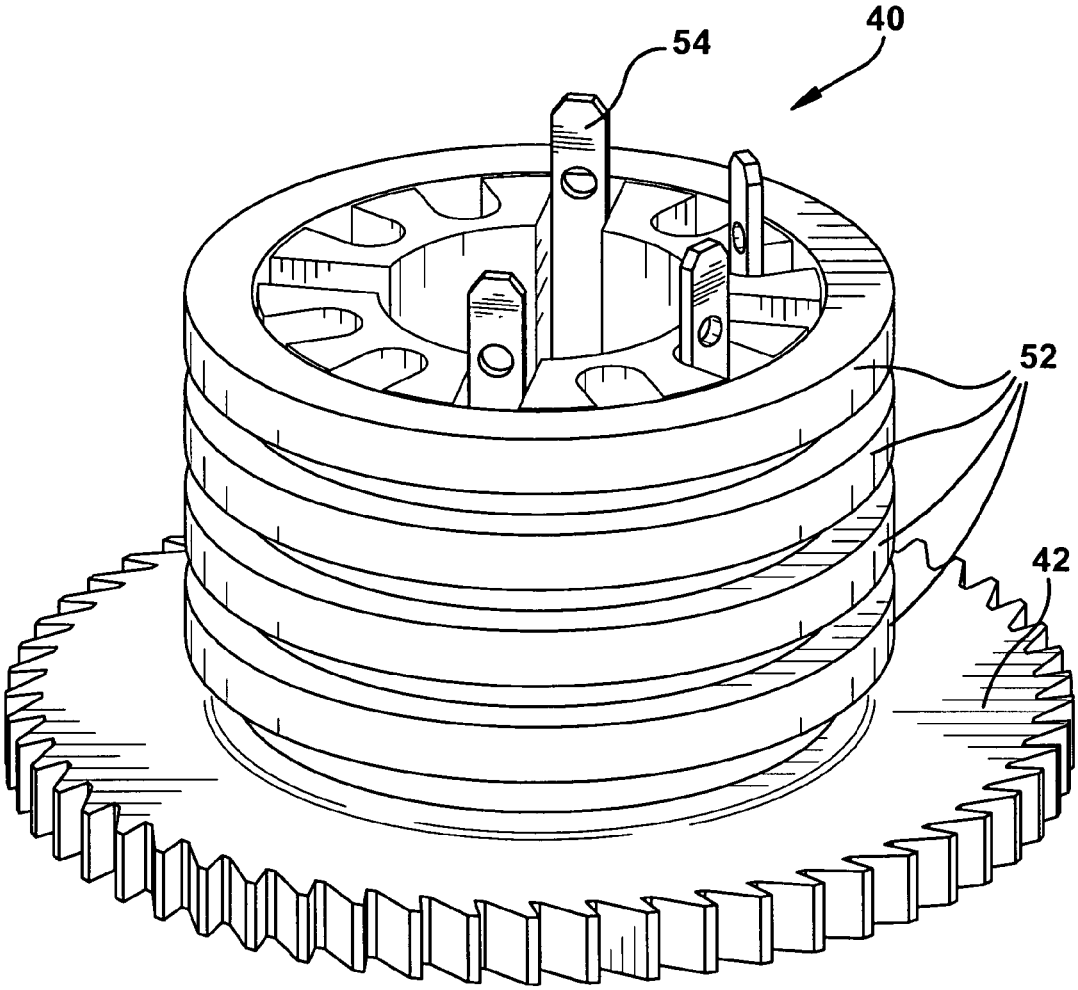
FIG. 3B illustrates a perspective view of the fully assembled rotating disc of FIG. 3A.

FIG. 3A illustrates an exploded, perspective view of the rotating disc assembly 40. The rotating disc assembly 40 may include a ratchet body 42, a plurality of insulated and electrically conductive slip rings 44, 46, 48, 50 and a plurality of spacers 52. Each of the slip rings 44, 46, 48, 50 may also include a flat 54 extending away from the ratchet body 42. The rotating disc assembly 40 may be assembled in any appropriate way or order, but is preferably assembled so that the right turn/stop slip ring 44 slides over the ratchet body 42 first, then a spacer 52, next the left turn/stop slip ring 46, then a spacer 52, next the tail/license slip ring 48, then another spacer 52, and lastly the ground slip ring 50, then a spacer 52. FIG. 3B illustrates a fully assembled view of the rotating disc assembly 40 of the adapter 10.

Figure 6C:
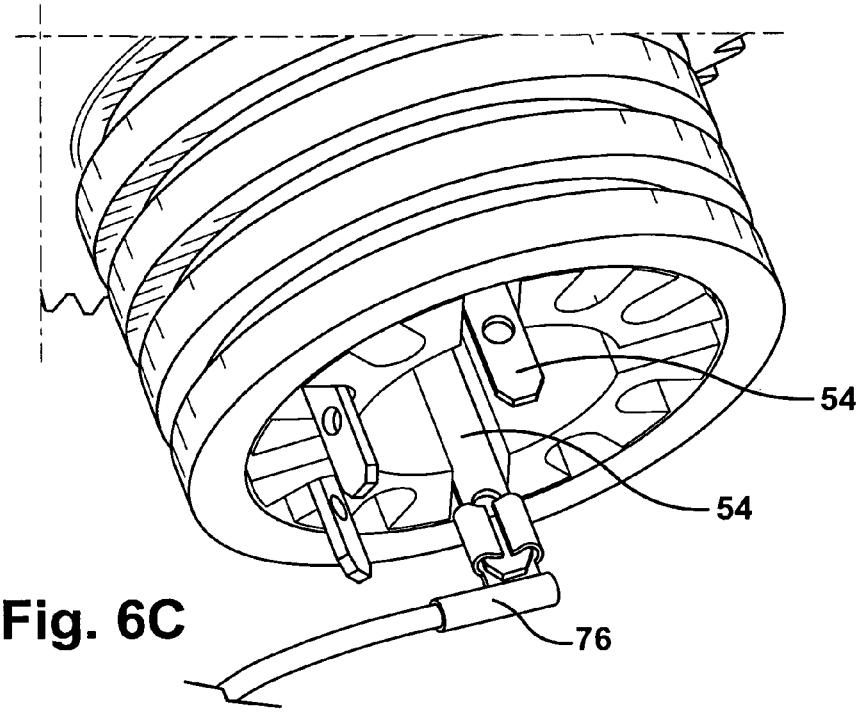
FIG. 6C illustrates a perspective view of the electrical connection details of FIG. 6A.
Figure 6D:
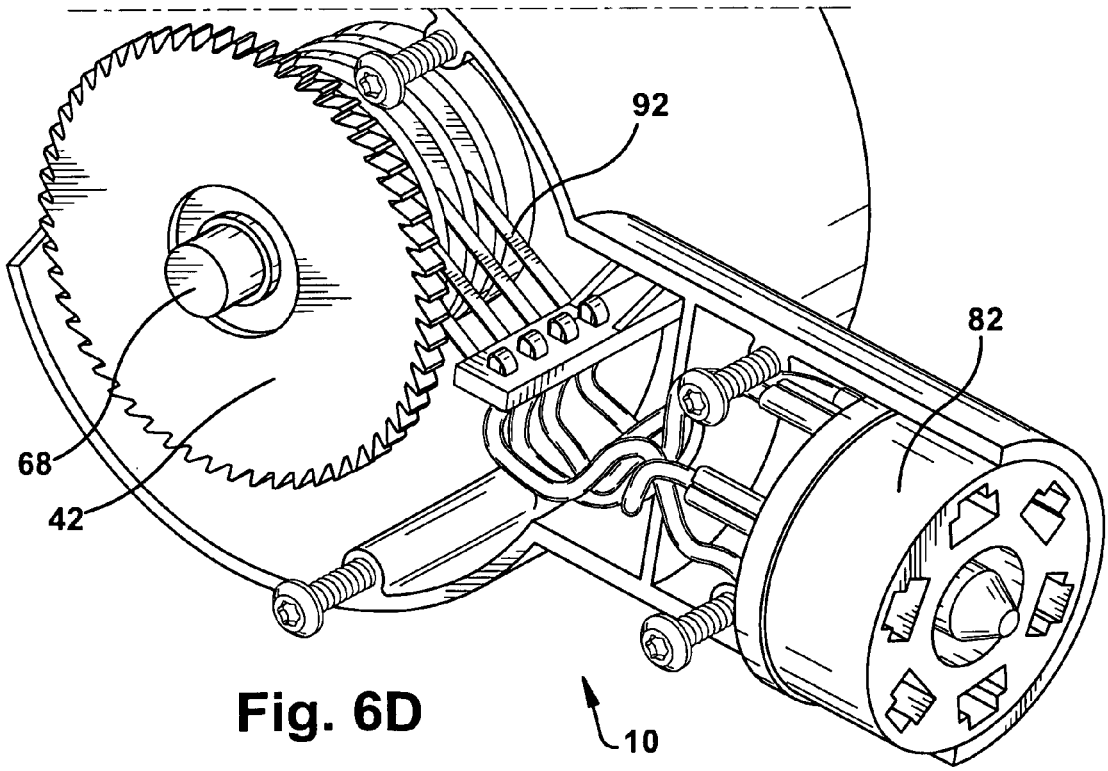
FIG. 6D illustrates another perspective cut out view of the adapter.

The rotating disc assembly 40 may also provide for an electrical connection to a 4-way flat connector harness 74 via flats 54 that may be designed to engage with flag terminals 76, as shown in more detail in FIG. 6C. The flag terminals 76 may be attached to the flats 54 by any appropriate means, but are preferably crimped onto an end of the 4-way flat harness 74, as shown in FIG. 6C.

Figure 4A:
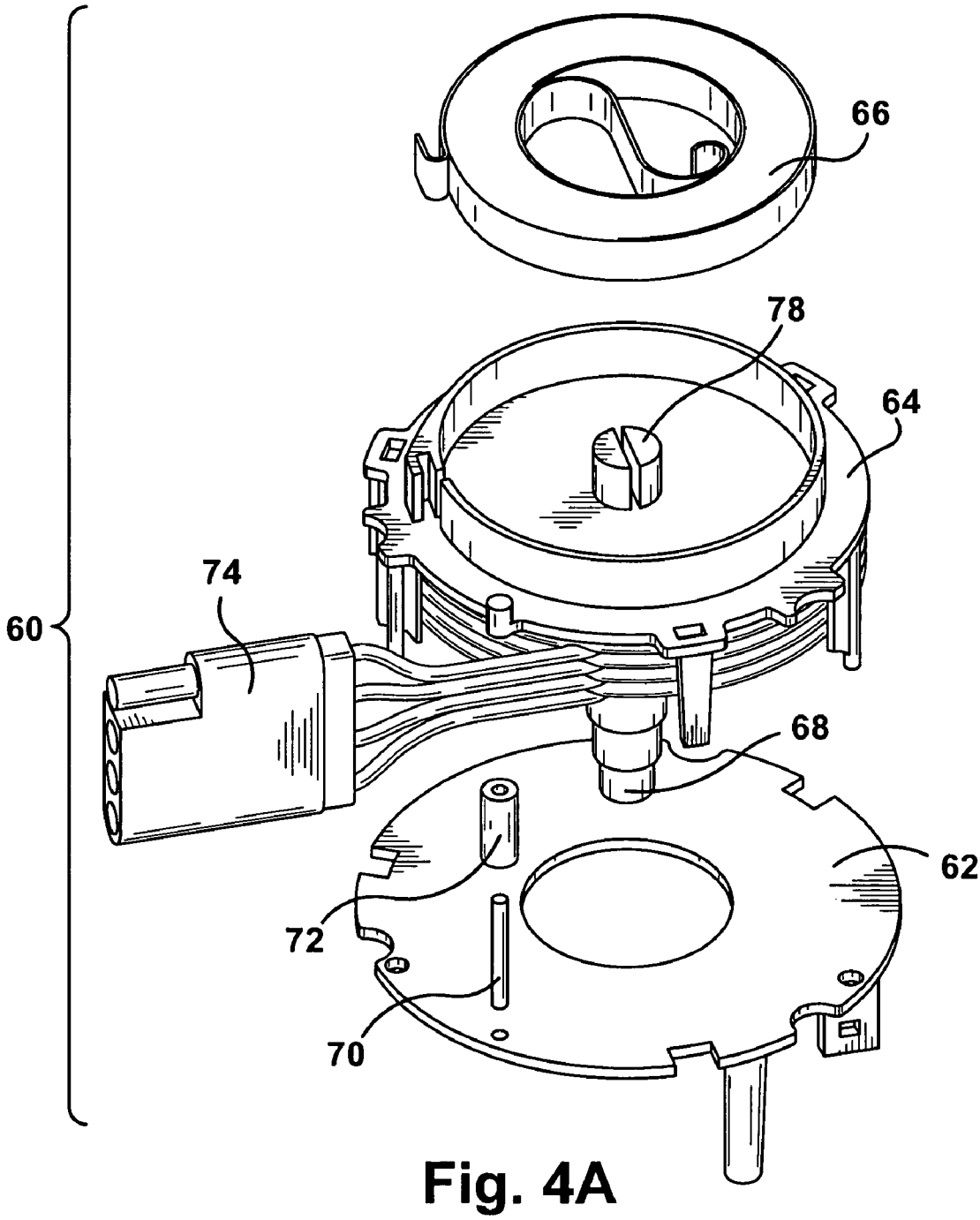
FIG. 4A illustrates an exploded view of the wire guide of the adapter.

FIG. 4A illustrates an exploded, perspective view of the wire guide assembly 60. The wire guide assembly 60 may essentially form a spool for the wire guide 62, as better shown in FIGS. 4B and 4C. The wire guide assembly 60 may include a wire guide 62, a spring housing 64, a power spring 66, a shaft 68, a dowel pin 70, a sleeve 72, and a 4-way flat connector harness 74.

Figure 4B:
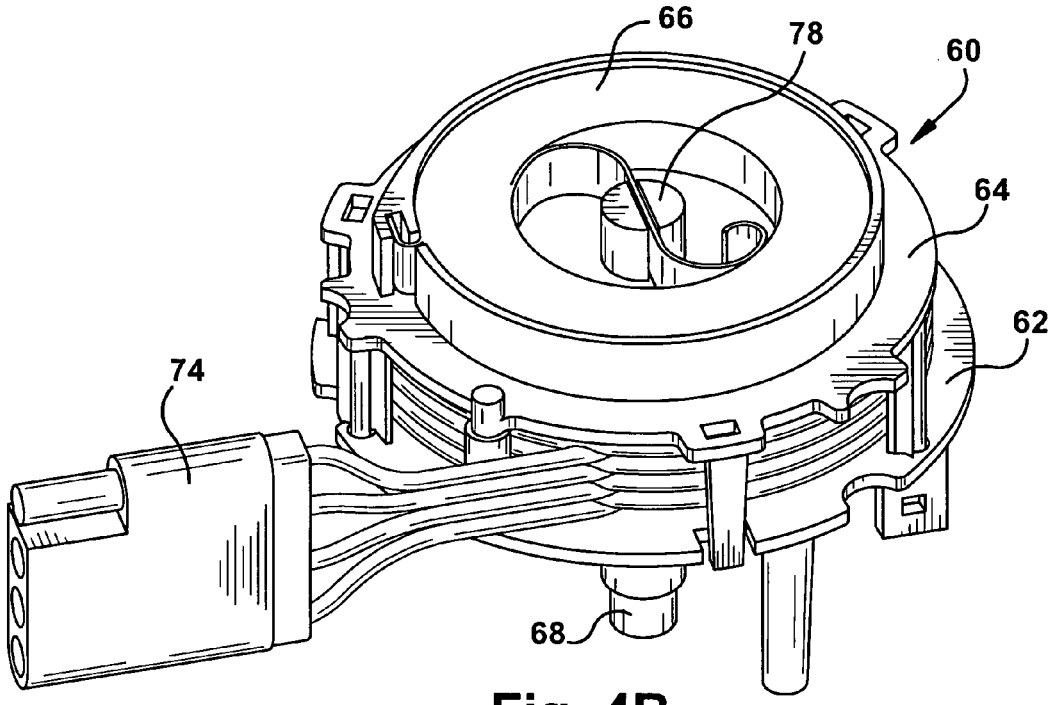
FIG. 4B illustrates a perspective view of the fully assembled wire guide of FIG. 4A.

The spring housing 64 may include a retainer 78 to aid in holding an end or portion of the power spring 66, as shown in FIG. 4B. The retainer 78 may be located at any appropriate position on a first side of the spring housing 64, but is preferably located at the approximate center of the spring housing 64. The 4-way flat connecter harness 74 may be of any appropriate length, but is preferably approximately forty-two (42) inches long so that the harness 74 may allow for an extended reach from the towing vehicle to the trailer's position. In addition, the 4-way flat connector harness 74 may mate with any industry standard 4-way flat trailer end connector. The shaft 68 may be located on the opposite side of the spring housing 64 in relation to the retainer 78.

Figure 4C:
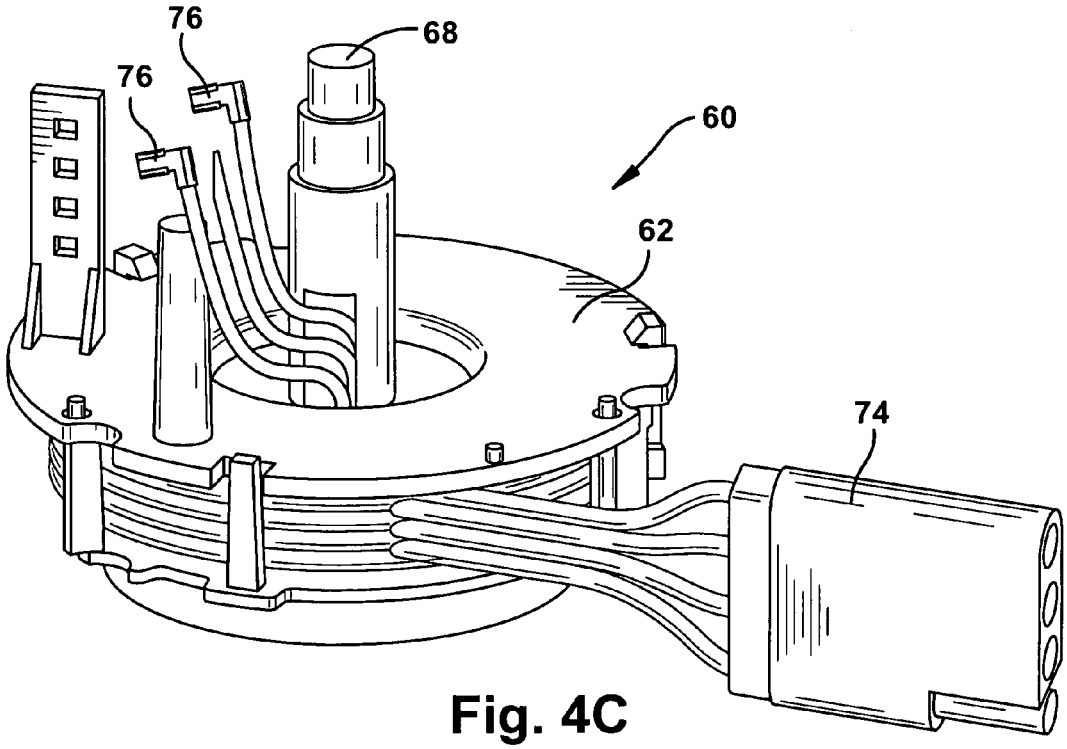
FIG. 4C illustrates another perspective view of the fully assembled wire guide of FIG. 4A.

With further reference to FIG. 4A, the wire guide assembly 60 may be assembled in any appropriate order or way, but is preferably assembled as described herein. The 4-way flat connector harness 74 and associated wiring may be wound around the shaft 68 and disposed between the spring housing 64 and the wire guide 62, thereby creating a rotatable cable spool as shown in FIGS. 4B and 4C. The coiled power spring 66 may be placed into the spring housing 64 and may thereby be engaged with the retainer 78, as shown in FIG. 4B. The dowel pin 70 and sleeve 72 may be located at any appropriate location on the wire guide 62 and may thereby provide support to the wire guide assembly 60 when an application of pulling force to the 4-way flat connector harness 74 is made, such as by an operator of a towing vehicle in preparation for connecting the harness 74 to a towed vehicle, for example.

As a pulling force is applied to the 4-way flat connector harness 74, the corresponding wires of the harness 74 may unwind on the spool or wire guide assembly 60. The 4-way flat connector harness 74 may also return back to its original position after the pulling force is released, thereby protecting and storing the connector harness 74 when not in use. The inner leads and flag terminals 76 of the 4-way flat harness 74, as shown in FIG. 4C, may be connected to the appropriate leads or flats 54 of the rotating disc assembly 40, as shown in FIG. 6C.

The wire guide assembly 60 and thus the retractable adapter 10 may utilize any appropriate type of extension and retraction. For example, the wire guide assembly 60 may function as a tape measure does with a manual type of locking device, such as a sliding lock device, or may function as a ratchet type mechanism with a ratchet body 42, or the like.

As a further example, the power spring or spring member 66 may be attached to the ratchet body 42 of the rotating disc assembly 40. Unwinding or pulling the connector harness 74 from the wire guide assembly 60 may cause the wire guide assembly 60 to wind or rotate the rotating disc assembly 40. Whereby, when in use, the connector harness 74 may be rapidly and easily deployed off of the wire guide assembly 60 within the upper and lower housings 12, 14 for coupling with the towed vehicle or trailer. When not in use, the connector harness 74 may be uncoupled from the towed vehicle to permit the connector harness 74 to be rewound or retracted back onto the wire guide assembly 60 within the upper and lower housings 12, 14 by a restoring torsional force created by the spring member 66.

Figure 5A:
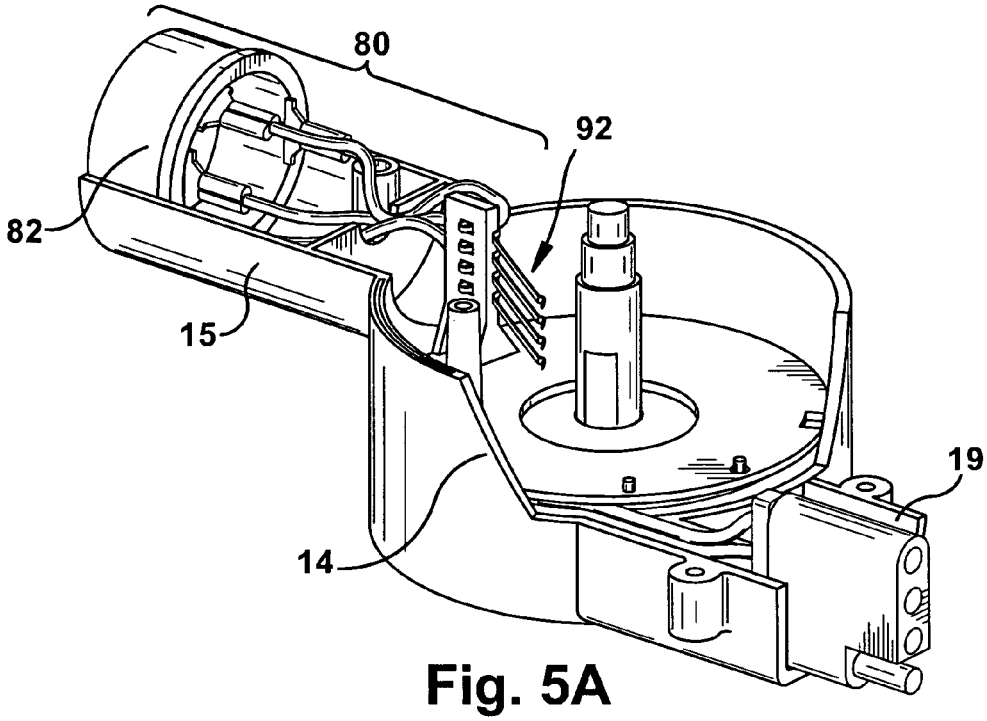
FIG. 5A illustrates a perspective view of a fully assembled 7-way blade connector insert of the adapter.

FIG. 5A illustrates a perspective view of the partially assembled adapter 10. FIGS. 5A-5D illustrate varying perspective views of the 7-way blade connector insert assembly 80. The 7-way blade connector insert assembly 80 may include a 7-way blade connector insert 82, a plurality of electrically conductive spring contacts 92, and wires 84, 86, 88, 90. The 7-way blade connecter insert assembly 80 may be easily plugged into a corresponding 7-way blade component on the vehicle.

Figure 5B:
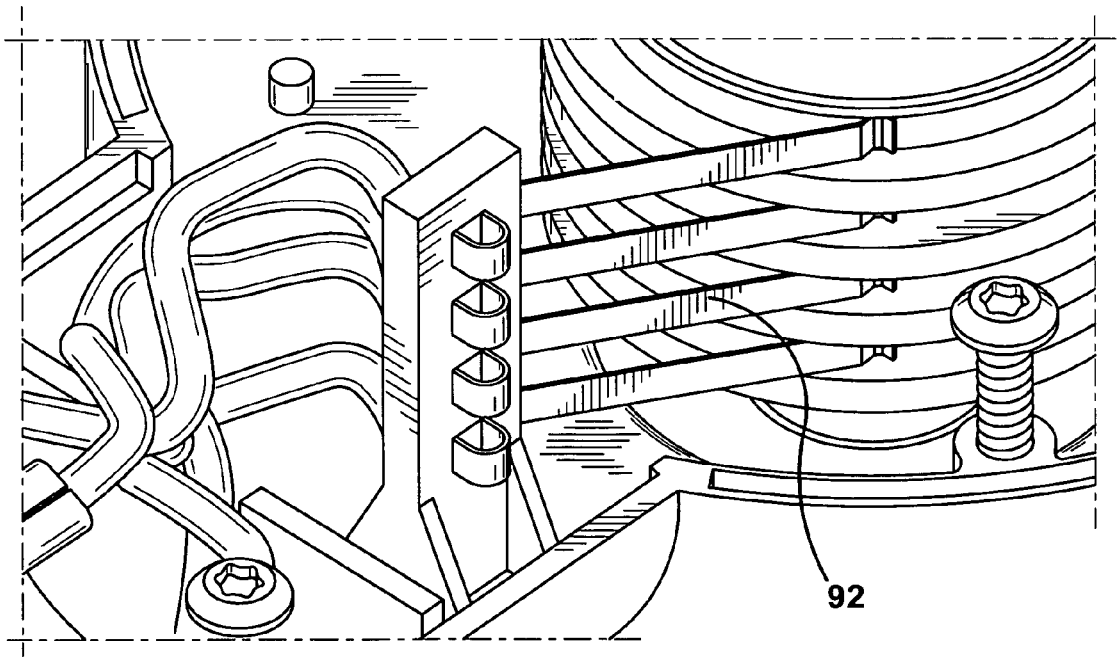
FIG. 5B illustrates an enlarged view of the spring contacts details of FIG. 5A.
Figure 5C:
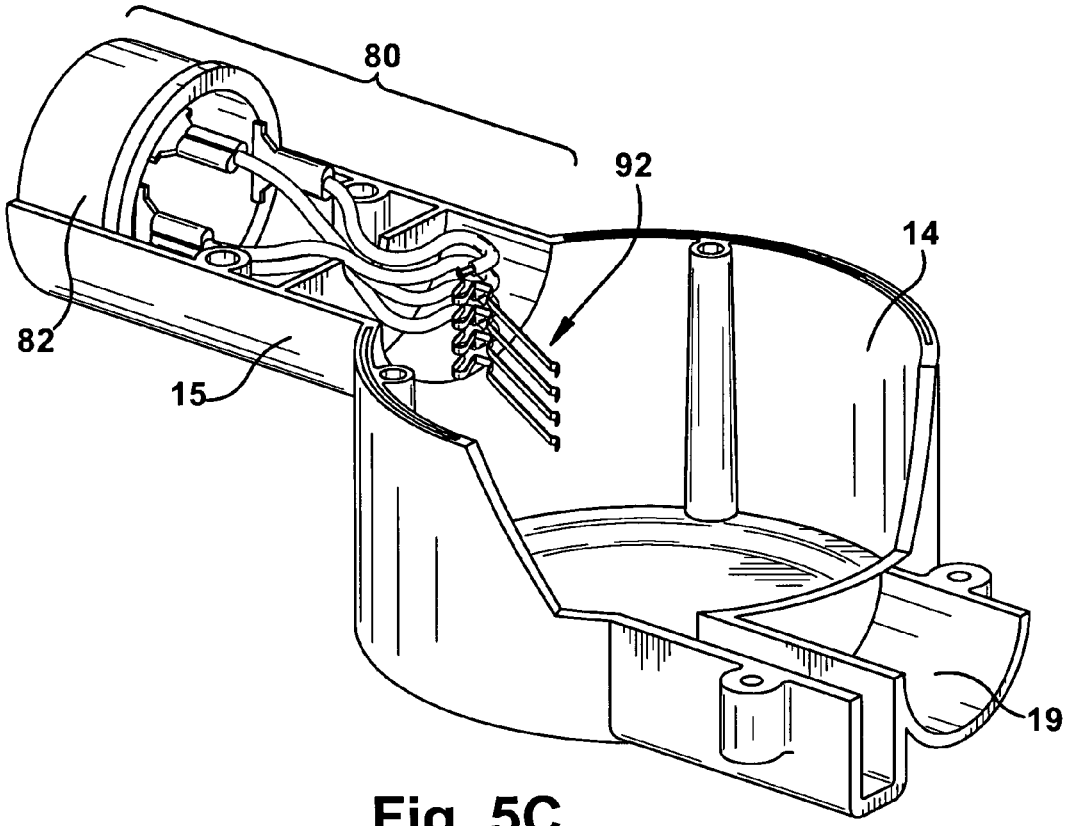
FIG. 5C illustrates a perspective view of the 7-way blade connector insert of FIG. 5A.
Figure 5D:
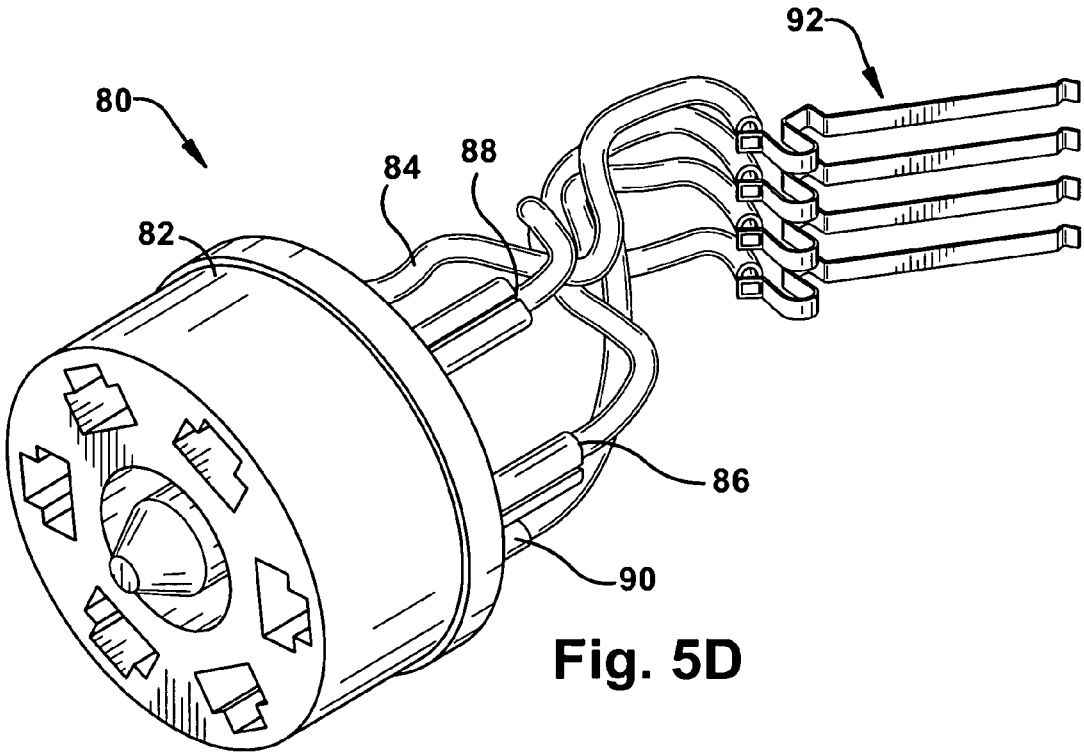
FIG. 5D illustrates a perspective view of a partially assembled 7-way blade connector insert of FIG. 5A.

The wires 84, 86, 88, 90 may be color-coded and may be of any appropriate color. Preferably, the wires are green 84, yellow 86, brown 88, and white 90. The wires 84, 86, 88, 90 may be crimped and soldered as best shown in FIG. 5D. FIG. 5B illustrates a detailed view of the spring contacts 92. There may be any appropriate number of spring contacts 92, but there are preferably four spring contacts 92.

FIGS. 6A-6D illustrate various cutout views of the cable retracting electrical device-adapter 10. These views show detailed views of the electrical connections of the adapter 10 that may permit transmission of electricity between the static spring contacts 92 and the rotatable electrically conductive slip rings 44, 46, 48, 50.

Figure 8A:
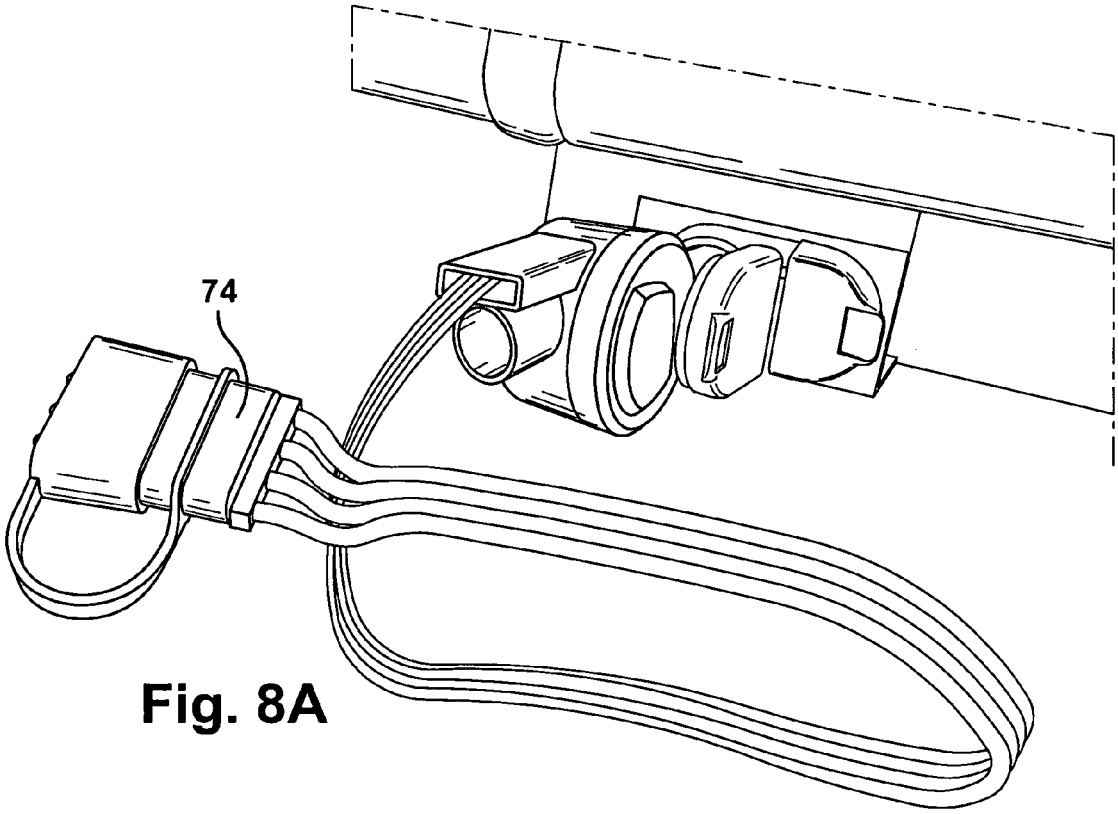
FIG. 8A illustrates a perspective view of an embodiment of the adapter in a fully extended state.
Figure 8B:
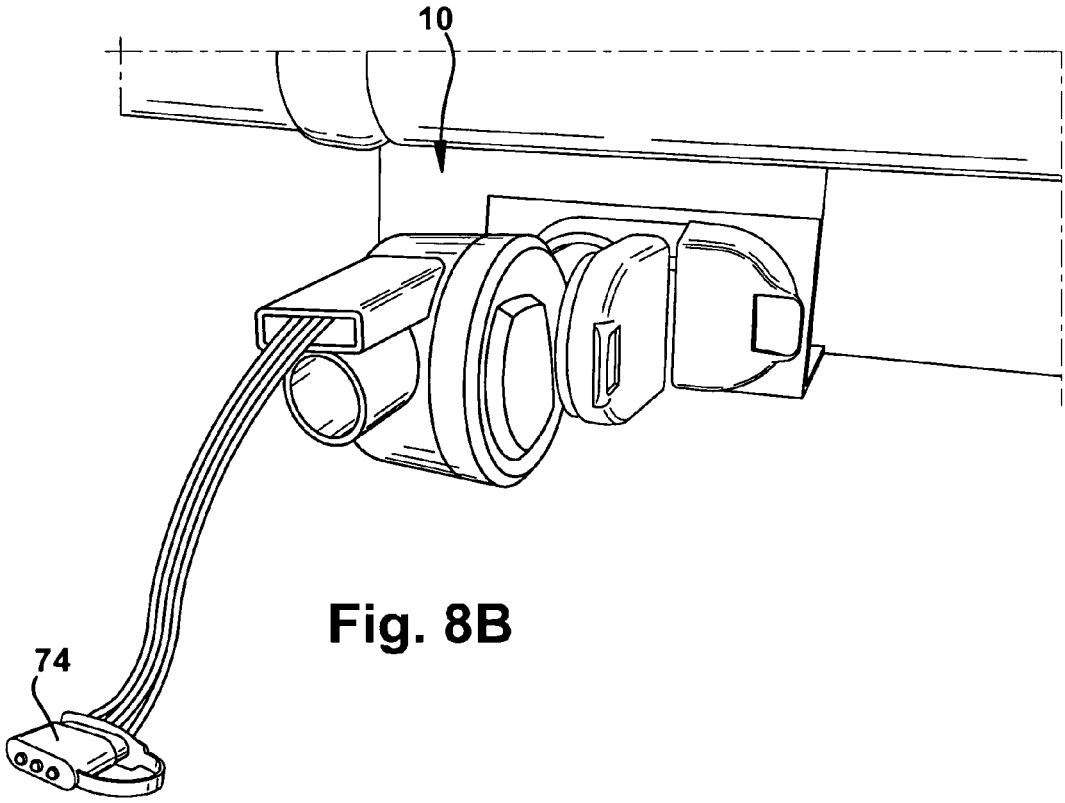
FIG. 8B shows another perspective view of the adapter of FIG. 8A in a partially extended state.

FIGS. 7A and 7B illustrate an embodiment of the retractable adapter 10 in a fully retracted state so that the connector harness 74 is completely stored away. FIGS. 7A and 7B also illustrate the adapter 10 having a plug-in tester with light emitting diodes 30. FIG. 8A illustrates a perspective view of an embodiment of the adapter in a fully extended state. FIG. 8B shows another perspective view of the adapter in a partially extended state.

In a preferred embodiment, the present invention may combine several different features into one. Preferably, the following different features may be combined into one, such as the adapter 10, that may include a 7-way blade 82 to a 4-flat connecter harness 74, retractable harness 74 storage, a circuit tester 28, and a backup alarm 20. It is to be understood that the adapter 10 may include any number of desired and appropriate features into one. The adapter 10 may also preferably be lightweight and compact in design, easy to manufacture and build, and easy to use and so that the adapter 10 does not require any tools, installation or mounting, just plug and play.

Another benefit of the adapter 10 is that the cable-winding feature of the wire guide assembly 60 and rotating disc assembly 40 has the ability to adjust the length of the 4-way flat connector harness 74 at any time without interrupting the electrical connection between the towing vehicle and towed vehicle or trailer. The connector harness 74 may freely extend to compensate for changing road conditions such as turns, hills or the like, for example. In addition, the connector harness 74 may freely retract at any length when the operator of the towing vehicle pushes the adjusting latch 16. Thus, when the adapter 10 is utilized, there should never be any slack in an electrical cable connecting the towing vehicle to a towed vehicle or trailer.

In addition, mounting and using the adapter 10 may be accomplished with a minimum of instruction. The adapter 10 may be used in conjunction with a variety of vehicles and trailers, such as recreational vehicles, tractor-trailers, boat trailers, livestock trailers, and cargo trailers, or the like, for example.

The embodiments of the invention have been described above and, obviously, modifications and alternations will occur to others upon reading and understanding this specification. The claims as follows are intended to include all modifications and alterations insofar as they come within the scope of the claims or the equivalent thereof.

Having thus described the invention, we claim:

1. A retractable adapter for electrically connecting a towing vehicle to a towed vehicle, said retractable adapter comprising:

a housing capable of engagement with a towing vehicle;

a retractable mechanism located within said housing, said retractable mechanism comprising:

a wire guide having a shaft;

a rotating electrical disc assembly located adjacent said wire guide; and a latch engageable with said rotating electrical disc assembly for operating said retractable mechanism;

a wire harness coiled around said wire guide shaft; and a six or seven-way electrical connector located within said housing.

2. The retractable adapter of claim 1 further comprising a circuit tester for monitoring connectivity wherein said circuit tester is connected to said wire harness.

3. The retractable adapter of claim 1 further comprising an alarm located within said housing.

4. The retractable adapter of claim 1, wherein said retractable adapter comprises an electrical connection between said six or seven-way electrical connector and a four-way flat electrical connector located at an end of said wire harness.

5. The retractable adapter of claim 4, wherein said six or seven-way electrical connector is stationary and said four-way flat electrical connector is extendable.

6. The retractable adapter of claim 1, wherein said latch engages a ratchet of said rotating electrical disc assembly.

7. The retractable adapter of claim 6, wherein said rotating electrical disc assembly includes at least one insulated and electrically conductive slip ring that includes a flat extending away from said ratchet.

8. The retractable adapter of claim 6, wherein said wire harness freely retracts to any length when said latch is engaged.

9. The retractable adapter of claim 2, wherein said circuit tester is built-in to said housing.

10. The retractable adapter of claim 4, wherein said circuit tester is plugged in to said housing.

11. The retractable adapter of claim 10, wherein said circuit tester covers said four-way flat electrical connector.

12. A retractable adapter for electrically connecting a towing vehicle to a towed vehicle, said retractable adapter comprising:

a housing engaged with a towing vehicle;

a seven pronged electrical connector located within said housing;

a rotating electrical mechanism located within said housing;

a retractable mechanism located within said housing;

a wire harness having a length coiled around said retractable mechanism; and wherein said retractable mechanism winds and unwinds said wire harness to adjust said wire harness length.

13. The retractable adapter of claim 12, wherein said wire harness comprises an extendable four-way flat connector.

14. The retractable adapter of claim 13, wherein said retractable adapter comprises an electrical connection between said seven pronged electrical connector and said four-way flat connector.

15. The retractable adapter of claim 12, wherein said wire harness length can be adjusted without interrupting the electrical connection between the towing vehicle and the towed vehicle.

16. The retractable adapter of claim 12, wherein said wire harness length can freely extend to compensate for changing road conditions.

17. A retractable adapter for electrically connecting a towing vehicle to a towed vehicle, said retractable adapter comprising:

a six or seven-way electrical connector located within a housing;

a retractable electrical mechanism located within said housing;

a wire harness coiled around said retractable electrical mechanism;

a latch engageable with said retractable electrical mechanism for winding and unwinding said wire harness about said retractable electrical mechanism;

an integral circuit tester connected to said wire harness, wherein said circuit tester monitors the electrical connection; and an alarm located within said housing.

18. The retractable adapter of claim 17, wherein said seven-way electrical connector is stationary and is engaged with a towing vehicle.

19. The retractable adapter of claim 18, wherein said wire harness comprises an extendable multi-pronged connector.

20. The retractable adapter of claim 19, wherein said retractable adapter comprises an electrical connection between said stationary seven-way electrical connector and said extendable multi-pronged-connector.

* * * * *

UNITED STATES PATENT AND TRADEMARK OFFICE

CERTIFICATE OF CORRECTION

PATENT NO. : 7,959,444 B2
APPLICATION NO. : 12/381287
DATED : June 14, 2011
INVENTOR(S) : Jerry Corless et al.

It is certified that error appears in the above-identified patent and that said Letters Patent is hereby corrected as shown below:

On the title page, item [54] and column 1, line 1:
delete "RETRACTABLE ADAPTER" and insert --RETRACTABLE ELECTRICAL ADAPTER WITH LATCH--

Signed and Sealed this
Twentieth Day of November, 2012

David J. Kappos

David J. Kappos
*Director of the United States Patent and Trademark Office*